United States Patent [19]

Miller et al.

[11] 4,009,819

[45] Mar. 1, 1977

[54] DISPOSABLE TABLE PAPER BASKET

[75] Inventors: Hallie E. Miller; Nancy W. Kittrell, both of Ormond Beach, Fla.

[73] Assignee: The Raymond Lee Organization, Inc., New York, N.Y. ; a part interest

[22] Filed: June 9, 1975

[21] Appl. No.: 585,045

[52] U.S. Cl. ..... 229/32; 229/16 A; 229/24

[51] Int. Cl.[2] ..... B65D 5/42; B65D 5/22

[58] Field of Search ..... 229/16 A, 16 E, 16 R, 229/16 D, 87 R, 87 F, 24, 32; 256/820

[56] References Cited

UNITED STATES PATENTS

| | | | |
|---|---|---|---|
| 205,355 | 6/1878 | Cole | 229/24 UX |
| 355,496 | 1/1887 | Albert | 229/24 |
| 418,180 | 12/1889 | Hicks | 229/24 |
| 1,046,321 | 12/1912 | Morrison et al. | 229/24 X |
| 1,567,594 | 12/1925 | Hitzert | 229/24 |
| 2,443,825 | 5/1941 | Holtkamp | 229/32 |

FOREIGN PATENTS OR APPLICATIONS

| | | | |
|---|---|---|---|
| 23,614 | 1/1890 | United Kingdom | 229/32 |

*Primary Examiner*—Davis T. Moorhead
*Attorney, Agent, or Firm*—Howard I. Podell

[57] ABSTRACT

A disposable paper basket formed of a folded sheet of shaped paper which may be employed for retention and removal of discarded packaging material and other debris from a dining table. The basket is formed of a flat sheet of paper from which a triangular section has been cut adjacent each corner of the sheet, and folded along pre-formed crease lines to form a container, open at the top, with the folded sections held in the erect position by clasp fasteners or folded sections of paper through holes in the sheet.

2 Claims, 2 Drawing Figures

DISPOSABLE TABLE PAPER BASKET

SUMMARY OF THE INVENTION

Our invention is a disposable paper basket formed of a folded sheet of shaped paper which may be employed for retention and removal of discarded packaging material and other debris from a dining table. The basket is formed of a flat sheet of paper from which a triangular section has been cut adjacent each corner of the sheet, and folded along pre-formed crease lines to form a container, open at the top, with the folded sections held in the erect position by clasp fasteners or folded sections of paper through holes in the sheet.

An advantage of our invention is that the pre-creased shaped sections of paper may be stored in a stack container, prior to use, on a table or counter top.

BRIEF DESCRIPTION OF THE DRAWINGS

The objects and feature of the invention may be understood with reference to the following detailed description of an illustrative embodiment of the invention, taken together with the accompanying drawings in which.

Figure 1:
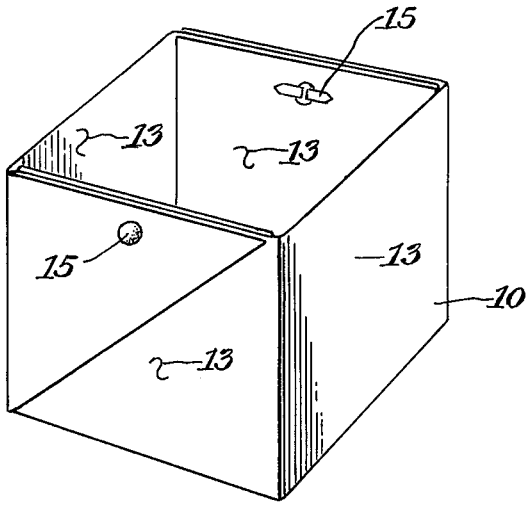
FIG. 1 is a perspective view of the container in the erected position.

DESCRIPTION OF THE PREFERRED EMBODIMENT:

Turning now descriptively to the drawings, in which similar reference characters denote similar elements throughout the several views, FIG. 1 illustrates the paper container 10 which is formed of a bottom section 14 and four side walls 13, with a pair of opposed sidewalls 13 each held together by paper rivets 15.

Figure 2:
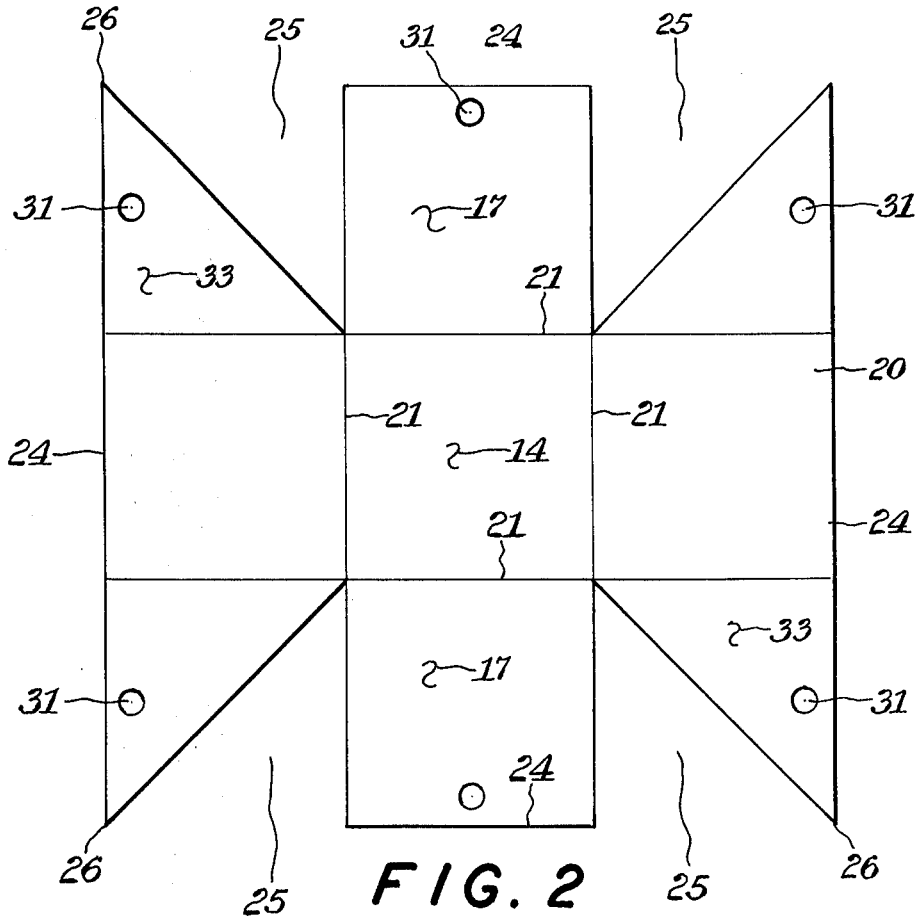
FIG. 2 is a plan view of the sheet, prior to forming into a container.

As shown in FIG. 2, the container 10 is formed of a square sheet of paper 20 folded on two sets of parallel crease lines 21. Each set of crease lines 21 is formed of two crease lines spaced equidistant from each other and from the nearby parallel edge 24 of the paper 20, with one set of crease lines 21 oriented perpendicularly to the other.

A triangular section 25 is cut-out of each corner 26 of the sheet, with each triangular section 26 bounded by a crease line 21, a diagonal line through corners 26 and the line 24 which is an extension of the outer edge of the sheet. Preferably, each pair of the cut-out sections 25 are oriented so as to be adjacent to a square section 17 of paper which folds into a wall 13, with two such square sections 17 on two opposing sides of the sheet 20 being each bounded by an outer edge 24 of the sheet, a crease line 21, and two cutout sections 25.

Six holes 31 are located so that each set of three holes 31 coincide along the same axis when the four side stations 13 are folded to planes perpendicular to the bottom section 14 and the triangular end sections

33, adjacent each cut-out section 25 are then folded along the adjacent crease line 21 by 90° of lie against and reinforce a wall section 13. A paper rivet 15 is inserted into each of the two sets of holes 31 in the erect position to hold the basket 10 together.

Alternately holes 31 may be shaped so that bent sections of paper of a wall or triangular end section 33 may be folded through the hole to hold the basket 10 erect, instead of a paper rivet 15.

Since obvious changes may be made in the specific embodiment of the invention describd herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A paper basket sheet for use in forming a basket for the retention and removal of dining debris which basket is shaped of folded sections of a cut-out paper sheet formed with pre-formed creased lines and with fastening holes, said paper sheets being stackable together in the unfolded form prior to use, in which, each sheet is formed of a square outline bounded by a first pair of spaced, straight parallel first edges that are each perpendicular to a second pair of spaced, straight parallel second edges, with each sheet formed with a first pair of parallel spaced first fold lines, each of said fold lines being equally spaced from a second first edge and an adjacent first fold line, and a second pair of parallel spaced second fold lines, each of said second fold lines being equally spaced from a said second edge and an adjacent second crease line, with a triangular cut-out section in each corner of the sheet, each said cut-out section bounded by a line extending from said first edge, a second fold line adjacent the said corner, and a diagonal line extending from the said corner to the intersection of said second fold line with a first fold line adjacent to said corner, said first and second fold lines being pre-formed with crease lines along the length of such fold lines that are bounded on each side of the line by the shaped sheet, together with six holes oriented on the sheet in two sets of three holes each, and located so that each set of three holes align with each other on one of two opposed sides of a basket formed by folding the sheet along the pre-creased fold lines to form an open basket of a cubical shape, the bottom of which is in the form of a square bordered by said first and second fold lines.

2. The combination as recited in claim 1 folded as a basket and retained in place by two fasteners, one of which is inserted into each set of aligned holes.

* * * * *